US010829902B2

(12) United States Patent
Baker

(10) Patent No.: US 10,829,902 B2
(45) Date of Patent: Nov. 10, 2020

(54) RETAINING WALL

(76) Inventor: David Baker, Surrey (GB)

( * ) Notice: Subject to any disclaimer, the term of this patent is extended or adjusted under 35 U.S.C. 154(b) by 24 days.

(21) Appl. No.: 13/055,839

(22) PCT Filed: Aug. 20, 2009

(86) PCT No.: PCT/GB2009/051040

§ 371 (c)(1),
(2), (4) Date: Jan. 25, 2011

(87) PCT Pub. No.: WO2010/026405

PCT Pub. Date: Mar. 11, 2010

(65) Prior Publication Data

US 2011/0116876 A1 May 19, 2011

(30) Foreign Application Priority Data

Sep. 2, 2008 (GB) ..... 0815961.8

(51) Int. Cl.
*E02B 3/04* (2006.01)
*E02B 3/06* (2006.01)
(Continued)

(52) U.S. Cl.
CPC ..... *E02D 5/02* (2013.01); *E02D 5/04* (2013.01); *E02D 5/20* (2013.01); *E02D 17/20* (2013.01); *E02D 19/06* (2013.01)

(58) Field of Classification Search
CPC . E02D 29/02; E02D 29/0241; E02D 29/0266; E02D 29/0225; E02D 29/0233;
(Continued)

(56) References Cited

U.S. PATENT DOCUMENTS 757,368 A * 4/1904 Truax ..... E02D 5/02 405/274
776,131 A * 11/1904 Gifford ..... E02D 5/08 405/279
(Continued)

FOREIGN PATENT DOCUMENTS

DE 804660 C 4/1951
DE 2631807 B1 2/1977
(Continued)

OTHER PUBLICATIONS

"The Design and Construction of Sheet Piled Cofferdams" by the Construction Industry Research and Information Association (CIRIA), published 1993 by Thomas Telford Ltd.
(Continued)

*Primary Examiner* — Benjamin F Fiorello
*Assistant Examiner* — Edwin J Toledo-Duran
(74) *Attorney, Agent, or Firm* — Ferguson Case Orr Paterson

(57) ABSTRACT

A retaining wall for retaining matter on a side thereof comprising: a plurality of upwardly projecting primary sheet piles spaced apart from each other and having first structural properties comprising at least one of weight, size, strength and depth to be installed in a supporting body; and one or more intermediate panels of material arranged so as to span the gap between a pair primary sheet piles and to retain at least a portion of the retained matter, wherein the one or more intermediate panels have second structural properties different from the first structural properties.

6 Claims, 1 Drawing Sheet

(51) Int. Cl.

| | |
|---|---|
| ***E02D 5/02*** | (2006.01) |
| ***E02D 5/04*** | (2006.01) |
| ***E02D 17/20*** | (2006.01) |
| ***E02D 19/06*** | (2006.01) |
| ***E02D 5/20*** | (2006.01) |

(58) Field of Classification Search
CPC .... E02D 5/02; E02D 5/04; E02D 5/06; E02D 5/08; E02D 17/207; E02D 5/16
USPC ..... 405/274, 275, 276, 277, 278, 280, 281, 405/284, 285
See application file for complete search history.

(56) References Cited

U.S. PATENT DOCUMENTS 807,378 A * 12/1905 Harold ..... E02D 5/04 405/277
808,985 A * 1/1906 Harold ..... E02D 5/04 405/277
818,596 A * 4/1906 Williams ..... E02D 5/04 405/276
848,144 A * 3/1907 Wemlinger ..... E02D 5/04 405/276
863,837 A * 8/1907 Dravo ..... E02D 5/04 405/281
888,899 A * 5/1908 Jackson ..... E02D 5/04 405/277
904,156 A * 11/1908 Slick ..... E02D 5/08 405/279
942,142 A * 12/1909 Holmes ..... E02D 5/12 405/275
952,645 A * 3/1910 Smith ..... E02D 29/0266 405/285
981,018 A * 1/1911 Sheldon ..... E02D 5/04 405/281
1,578,861 A * 3/1926 Squire ..... E02D 5/20 405/285
1,746,470 A * 2/1930 Hennessey ..... B65D 85/62 217/36
1,784,777 A * 12/1930 Beaujean ..... E02D 5/04 405/279
1,942,163 A * 1/1934 Di Zoppola ..... E02B 3/04 405/279
1,943,800 A * 1/1934 Morrison ..... E02D 5/20 405/285
2,089,763 A * 8/1937 Rotinoff ..... E02D 5/12 405/275
2,275,662 A * 3/1942 Sturdy ..... E02D 5/16 29/281.6
2,769,277 A * 11/1956 Keelor ..... A01G 9/28 47/33
3,059,436 A * 10/1962 Hermann, Jr. ..... E02D 5/04 405/278
3,971,224 A * 7/1976 Elkuch ..... E02D 5/04 405/285
4,561,804 A * 12/1985 Weatherby ..... 405/262
5,030,034 A * 7/1991 Bodine ..... B09B 1/00 405/129.5
5,106,233 A * 4/1992 Breaux ..... 405/129.8
5,134,815 A * 8/1992 Pickett ..... E01F 8/0023 405/285
5,158,399 A * 10/1992 Flores ..... E02D 17/04 405/262
5,360,296 A * 11/1994 Angelette ..... E02D 29/0266 405/285
5,368,416 A * 11/1994 Cataldo ..... E01F 8/0011 405/258.1
5,501,550 A * 3/1996 Calabrese ..... 405/232
6,732,483 B1 * 5/2004 White ..... E02D 5/08 52/592.1
7,571,577 B2 * 8/2009 Nanayakkara ..... E04H 9/10 14/73.5
7,997,830 B2 * 8/2011 Wendt ..... E02B 3/108 405/279
2003/0223824 A1 * 12/2003 Jordan ..... E02D 29/02 405/284
2008/0145153 A1 * 6/2008 Wendt ..... E02B 3/106 405/274

FOREIGN PATENT DOCUMENTS

| | | | |
|---|---|---|---|
| DE | 2819737 | A1 | 11/1979 |
| DE | 9211306 | U1 | 11/1992 |
| DE | 102006041049 | | 3/2008 |
| FR | 461687 | A | 1/2014 |
| GB | 306928 | A | 6/1929 |
| JP | 62133209 | A | 6/1987 |
| JP | 20213508 | A | 8/2000 |

OTHER PUBLICATIONS

"The observational approach to design of a sheet-piled retaining wall" by Young, D. K. and Ho, E. W. L., Geotechnique, vol. 44(4), 637-654, published.
"EAU, 2004. Recommendations of the Committee for Waterfront Structures Harbours and Waterways", 8th Edition, Translation of the 2004 10th German Edition, Ernst & Sohn, Berlin.
CIRIA C580, "The Design and Construction of Sheet Piled Cofferdams" by the Construction Industry Research and Information Association (CIRIA), published 1993 by Thomas Telford Ltd dealing with retaining walls.
Third Party Observations filed at the EPO for Application No. EP09785505.0 Dated Sep. 11, 2013.

* cited by examiner

RETAINING WALL

This is a National Stage Application of PCT/GB2009/051040 filed Aug. 20, 2009, published as WO 2010/026405 A1, and claiming priority from GB0815961.8 filed Sep. 2, 2008.

BACKGROUND OF THE INVENTION

Field of the Invention

This invention relates to a retaining wall and to a method of constructing the same.

Description of the Related Art

A retaining wall is a structure that holds back soil or rock from a building, structure or area. Retaining walls prevent down-slope movement or erosion and provide support for vertical or near-vertical grade changes. Cofferdams and bulkheads, structures that hold back water, are also considered retaining walls.

One type of conventional retaining wall is formed of sheet piling. Sheet pile walls are made out of steel, vinyl, fibreglass, reinforced concrete or plastic sheet piles driven into the ground. Sheet pile walls are typically constructed by driving steel sheets into the ground to permit excavation or filling on one side of the wall. They are considered to be most economical where retention of higher earth pressures of soft soils is required. However, sheet piles can be costly and less adaptable to difficult driving conditions, particularly where boulders or irregular rock surfaces occur in the ground.

To cater for difficult driving conditions, sheet piles are often designed for improved drivability rather than to suit the structural requirements of the retaining wall to be formed. This therefore results in a use of sheet piles which is inefficient and not cost effective.

SUMMARY OF THE INVENTION

According to the invention, there is provided a retaining wall for retaining matter on a side thereof comprising: a plurality of upwardly projecting primary sheet piles spaced apart from each other and having first structural properties comprising at least one of weight, size, strength and depth to be installed in a supporting body; and one or more intermediate panels of material arranged so as to span the gap between a pair of primary sheet piles and to retain at least a portion of the retained matter, wherein the one or more intermediate panels have second structural properties different from the first structural properties.

Embodiments of the invention therefore capitalise on the use of (primary) sheet piles which are designed for a primary goal, such as drivability, strength or minimum depth required for overall wall stability, to offset against the structural properties of panels placed between a pair of (primary) sheet piles. In this way, the sheet piles may provide the majority of the structural capacity for the vertical spanning function of the retaining wall. Thus, the intermediate panels need not have the same structural properties as the primary sheet piles. For example, they need not be driven into the supporting ground as far as the primary sheet piles, and may be of lesser weight, size, cost and/or strength. Cost savings can therefore be made in respect of the intermediate panels and the wall may be a more sustainable product.

Taking advantage of surplus structural capacity of the primary sheet piles, for example, embodiments are applicable to forming retaining walls where installation conditions require heavier sections than structurally required for the retaining wall function.

The one or more intermediate panels may bear on or be connected to the pair of primary sheet piles so as to provide improved lateral stability. Such connection may also be adapted so as to provide a water-tight seal between the intermediate panel(s) and the primary sheet piles.

An embodiment may further comprise a stopper or arrester adapted to restrict vertical movement of the one or more intermediate panels at a predetermined position, thereby assisting correct positioning of the intermediate panel(s) when constructing the retaining wall. The stopper/arrester can be located separately from or fixed to either a primary sheet pile or intermediate panel.

An example of the invention will now be described in more detail with reference to the accompanying drawings, in which:

DETAILED DESCRIPTION OF THE INVENTION

Figure 1:
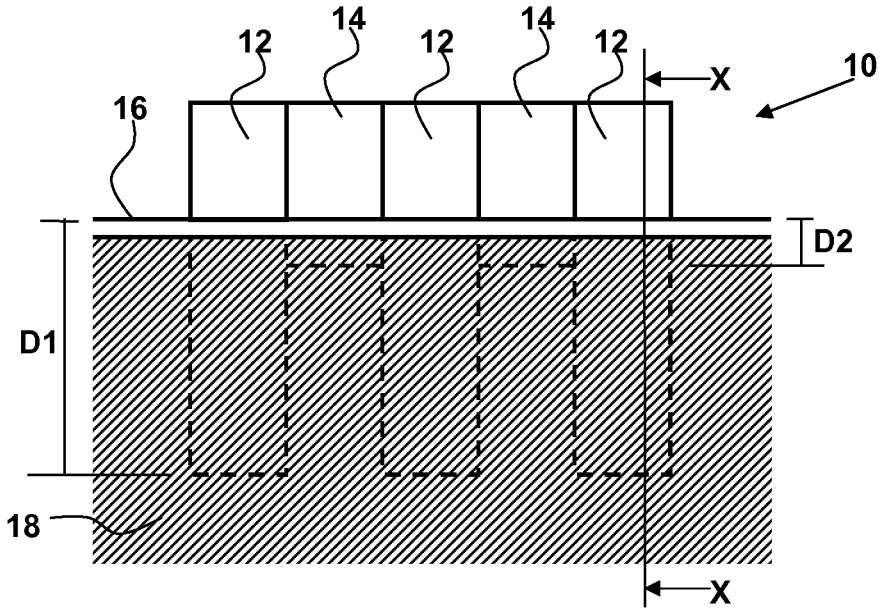
FIG. 1 is a front sectional elevation of a retaining wall according to an embodiment of the invention, wherein the section is taken along the line Y-Y of FIG. 2.
Figure 2:
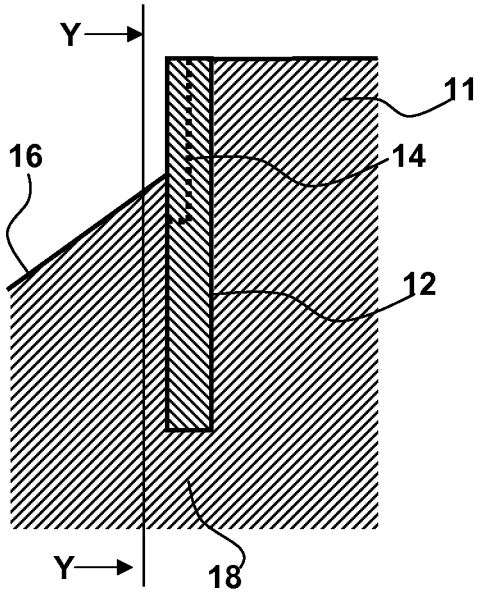
FIG. 2 is a cross sectional view taken along the line X-X of FIG. 1.

Referring to FIGS. 1 and 2, a retaining wall 10 for retaining matter 11 such as soil and/or water on a side thereof is shown. The retaining wall 10 comprises a combination of primary sheet piles 12 spaced apart from each other and intermediate panels 14 spanning the gaps between pairs of primary sheet piles 12.

The main structural support to the wall is provided by primary sheet piles 12 which are driven into the surface 16 of the supporting body 18 (in other words, the supporting ground) to a depth "D1". The intermediate panels 14 are driven into the supporting body to a lesser depth "D2" (i.e. D1>D2) and retain at least a portion of the retained matter 11. In other words, the bottom of the one or more intermediate panels is vertically offset with respect to the bottom of the pair of primary sheet piles. It will, however, be understood that "vertically offset" in the context of this invention should be taken to mean being deliberately and knowingly vertically offset as opposed to being offset by a small amount due to construction tolerances when attempting installation at substantially equal depths. That is, "vertically offset" should be understood to not encompass the situation where sheet piles have been intended to be installed at substantially equal depth in a supporting body but, due to construction difficulties and/or tolerances, are slightly vertically offset from each other. For example, in embodiments of the invention, the bottom of the one or more intermediate panels is vertically offset with respect to the bottom of the pair of primary sheet piles example, by more than 10 cm, preferably more than 50 cm, and even more preferably more than 1 m.

The primary sheet piles 12 serve as the primary members for providing structural restraint to bending and shear in the wall, while the intermediate panels retain matter 11, such as soil and/or water, by spanning horizontally between pairs of primary sheet piles 12.

Since they need only be adequate to retain the matter, and not provide the primary structural support of the wall, the intermediate panels 14 may be of lesser weight, size and/or strength than the primary sheet piles 12 and are normally not driven into the supporting ground as far as the primary sheet piles. In the illustrated embodiment, the intermediate panels 14 are of the minimum length required to support the retained material by spanning horizontally between primary panels or to satisfy other requirements such as water cut-off.

The intermediate panels 14 may be formed from any suitable material including plastic, reinforced plastic, wood, cloth, concrete, reinforced concrete, and metal, for example. The intermediate panels 14 may also be formed from the same material as the primary sheet piles 12, in which case the intermediate panels 14 may also be sheet piles 12.

Although the intermediate panels 14 are shown to have smaller dimensions than the primary sheet piles 12, they may have the same dimensions as the primary sheet piles but be of different weight and/or strength, for example. Alternatively, they may be identical structurally to the primary piles but differ in being shorter and in being designed to span horizontally between the primary piles without needing to rely on any vertical bending capability of the intermediate section. Further, although FIGS. 1 and 2 illustrate the tops of the primary sheet piles 12 and intermediate panels 14 as being flush with each other, they need not be flush with each other in other embodiments.

In the illustrated embodiment, the intermediate panels 14 are connected to the primary sheet piles 12 so as to form a seal which prevents or restricts the passage of water through the retaining wall. Further, the intermediate panels 14 are reinforced by structural members (not shown) as required.

The retaining wall 10 is constructed by arranging a plurality of primary sheet piles 12 to be spaced apart from each other and project downwardly into the supporting ground. One or more intermediate panels 14 are arranged so as to span the gap between a pair of primary sheet piles 12 and to retain at least a portion of the retained matter 11. In doing so, the intermediate panels 14 are also arranged to project downwardly into the supporting ground to a lesser extent than the pair of primary sheet piles.

The intermediate panels 14 may be driven or pushed into place separately or may be secured to the primary sheet piles 12 and installed together with the primary sheet piles 12.

To assist in alignment, an embodiment may be installed using temporary longer secondary panels which may either: (a) consist of two sections releasably connected together to form a temporary longer panel which is later partially withdrawn and the top section released from the bottom section; or (b) comprise a longer panel which is subsequently withdrawn fully and replaced with shorter/smaller intermediate panel.

Stopper or arresting apparatus can be used on the primary pile sheets, the intermediate panels, and/or the supporting body to restrict vertical movement of the intermediate panels at a required level and assist their correct location.

Embodiments may be particularly suited to applications such as motorway widening on embankments where relatively large and/or long sheet piles may be required to retain a low height of ground. In such situations, the sheet piles are typically sized for drivability rather than to suit the retaining wall structural requirements. The sheet piles therefore have considerable surplus structural capacity which can be traded off against the structural properties of the intermediate panels 12 which enable cost savings to be made, for example.

Where a water cut-off function is required, this may be achieved in a variety of ways, for example by:

(i) Driving or pressing the intermediate sections deeper to achieve a cut-off, increasing section size as necessary for driveability and or aiding driving by suitable means such as pre-augering or jetting.

(ii) Installing the retaining wall along the line of a pre-installed low permeability cut-off barrier formed by any means such as a slurry wall (a trench evacuated and back-filled with cement bentonite slurry so as to form a water cut-off), a stabilised soil wall or a vib wall (a water cut-off formed by driving a large steel I-beam while injecting bentonite slurry. Adjacent drives are overlapped to form a continuous cut-off).

(iii) Driving or pressing to the required cut-off depth a thick intermediate section of the same shape as a light intermediate section (a "mandrel") with a grout tube attached and injecting grout as the mandrel is withdrawn, then driving a thin intermediate section to the normal depth of an intermediate section according to an embodiment.

(iv) As (iii) but with the thin intermediate section driven to full depth (i.e. the same depth as the primary sheet piles).

(v) As (iii) or (iv) but without grout injection.

A similar technique of using a mandrel as described above, with or without a grout tube and grouting, may be used to advance lighter intermediate sections to a depth in excess of that to which the intermediate section can be advanced by normal means, including driving aided by pre-augering or jetting.

While specific embodiments have been described herein for purposes of illustration, various modifications will be apparent to a person skilled in the art and may be made without departing from the scope of the invention.

For example, embodiments may be implemented in cantilever or anchored retaining wall application, and the intermediate panels may be of an arched form to operate either in tension or compression to retain matter.

Also, intermediate panels may be of greater width than the gap between a pair of spaced apart sheet piling. In such embodiments, the panel(s) may not connect to sheet piling but instead simply slot behind/in-front so that they bear on a side of the sheet piling.

The invention claimed is:

1. A retaining wall for retaining matter on a side thereof comprising:

a plurality of upwardly projecting primary structural members spaced apart from each other and having a first structural property comprising depth installed in a supporting body; and one or more intermediate panels of material arranged so as to span horizontally the gap between a pair of the primary structural members and bear on or be connected to the pair of primary structural members thus retaining some matter between the primary structural members by transferring load from said matter horizontally to the pair of primary structural members, wherein the primary structural members are sheet piles, and wherein the one or more intermediate panels project at least partially into the supporting body and to a lesser depth than the primary structural members so as to have a second structural property different from the first structural property such that there is a vertical offset between the first structural property and the second structural property, wherein the vertical offset is more than 1 m, and wherein the one or more intermediate panels are not designed to contribute to vertical spanning bending and shear restraint in the retaining wall such that the primary structural members are adapted to provide the majority of the structural restraint to said vertical spanning bending and shear in the retaining wall.

2. The retaining wall of claim 1, wherein the one or more intermediate panels are connected to the pair of primary structural members.

3. The retaining wall of claim 1, wherein the one or more intermediate panels comprise at least two panels of material connected to each other.

4. The retaining wall of claim 1, further comprising a stopper adapted to restrict vertical movement of the one or more intermediate panels at a predetermined position.

5. A method of constructing a retaining wall for retaining matter on a side thereof, wherein the method comprises the steps of:

arranging a plurality of primary structural members so that the primary structural members are spaced apart from each other and project downwardly into a supporting body, the primary structural members having a first structural property comprising depth installed in the supporting body; and arranging one or more intermediate panels so as to project at least partially into the supporting body and to a lesser depth than the primary structural members so as to have a second structural property different from the first structural property such that there is a vertical offset between the first structural property and the second structural property and to span horizontally the gap between a pair of the primary structural members and bear on or be connected to the pair of primary structural members thus retaining some matter between the primary structural members by transferring load from said matter horizontally to the pair of primary structural members, wherein the vertical offset is more than 1 m, and wherein the primary structural members are sheet piles, and wherein the one or more intermediate panels are not designed to contribute to vertical spanning bending and shear restraint in the retaining wall such that the primary structural members are adapted to provide the majority of the structural restraint to said vertical spanning bending and shear in the retaining wall.

6. The method of claim 5, further comprising the step of connecting the one or more intermediate panels to the pair of primary structural members.

* * * * *